US005616874A

United States Patent [19]

Kraus et al.

[11] Patent Number: 5,616,874

[45] Date of Patent: Apr. 1, 1997

[54] SITTING POSITION MUSICAL INSTRUMENT RETAINER

[75] Inventors: Peter C. Kraus, deceased, late of Sherman Oaks, Calif.; Debra J. Kraus, heiress, 13368 Huston #A, Sherman Oaks, Calif. 91423

[73] Assignee: Debra J. Kraus, heiress, Sherman Oaks, Calif.

[21] Appl. No.: 406,575

[22] Filed: Mar. 20, 1995

[51] Int. Cl.[6] ..... G10D 3/00

[52] U.S. Cl. ..... 84/327

[58] Field of Search ..... 84/280, 327, 385 A, 84/421, 453; 224/910

[56] References Cited

U.S. PATENT DOCUMENTS

| | | | |
|---|---|---|---|
| 672,444 | 1/1901 | Haille | 84/327 |
| 1,945,162 | 3/1934 | Rasmussen | 84/327 |
| 2,273,136 | 6/1942 | Orech | 84/327 |
| 3,037,416 | 8/1962 | Cunningham | 84/327 |
| 3,102,446 | 12/1963 | Raleigh | 84/327 |
| 3,366,293 | 2/1968 | Fyke | 84/327 |
| 3,371,570 | 7/1968 | Lester | 84/327 |
| 3,955,461 | 8/1976 | Ivie | 84/327 |
| 4,251,016 | 10/1981 | O'Rafferty | 84/327 |
| 4,966,062 | 10/1990 | Driggers et al. | 84/327 |
| 5,069,103 | 12/1991 | Healy | 84/327 |
| 5,431,320 | 7/1995 | Hash | 84/237 X |

*Primary Examiner*—Patrick J. Stanzione

[57] ABSTRACT

A lightweight, adjustable, removable sitting position retainer for a musical instrument of the guitar family consisting of a waist belt (23), three cords (14) adjustably tied on one end to said belt (23), one right, two left, right side cord running to right side of instrument gripping suction cup (16), or peg (49) retaining bowline knot (42) loop (48), one left side cord (14) to sound hole grasping hook (13) or left peg (49) retaining bowline knot (42) loop (48), other left side cord (14) running to top side of instrument gripping suction cup (16) or front side of instrument holding suction cup (16).

20 Claims, 8 Drawing Sheets

36
15
16
34
41
32
13
42
14
14
23
14
16
15
15

Fig.4b
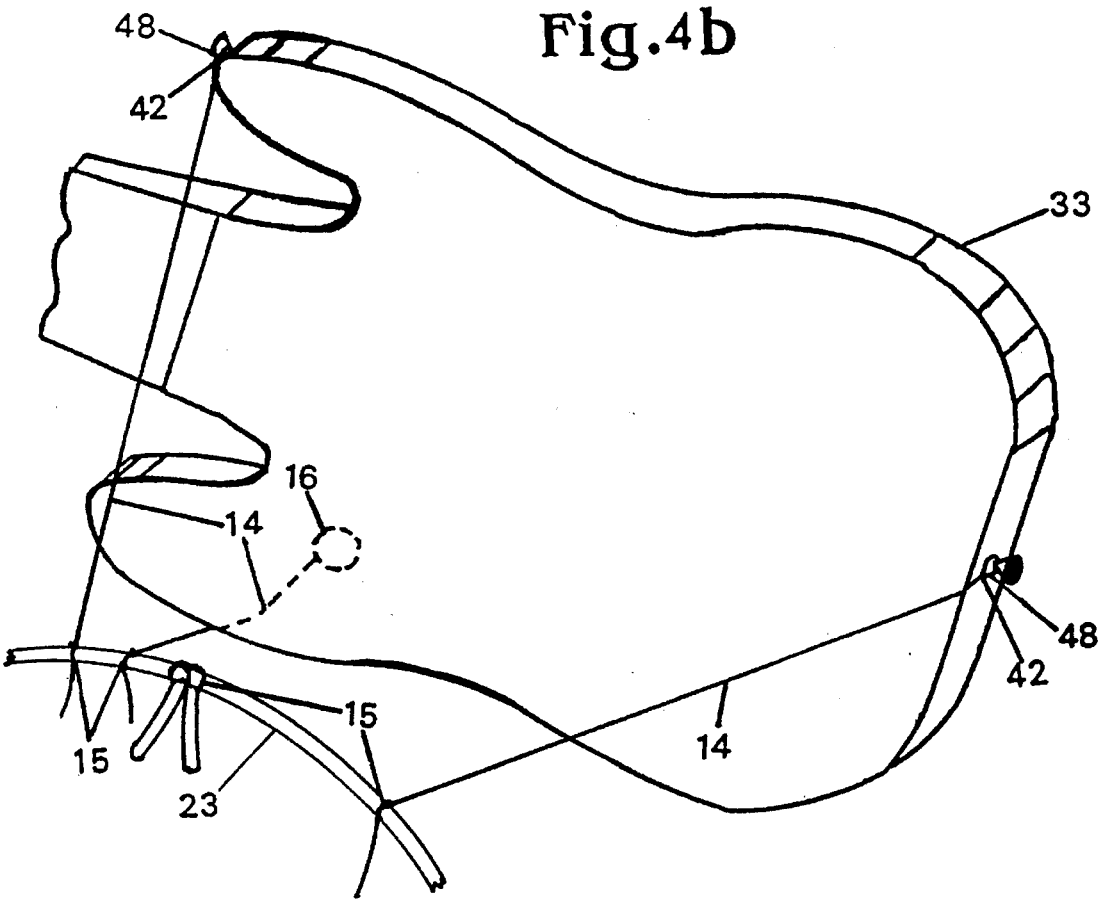
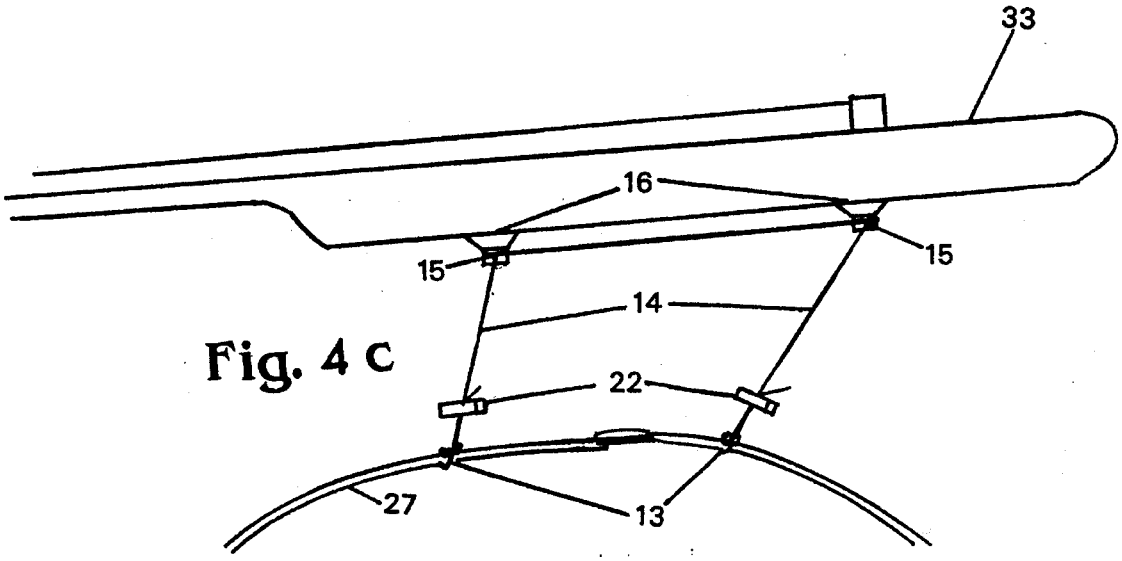
Fig. 4 c

Fig.10b
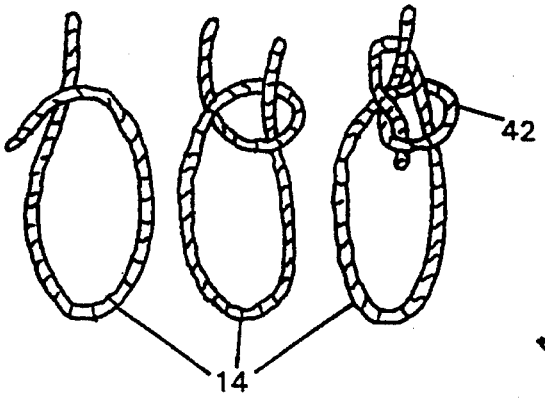
Fig.11a
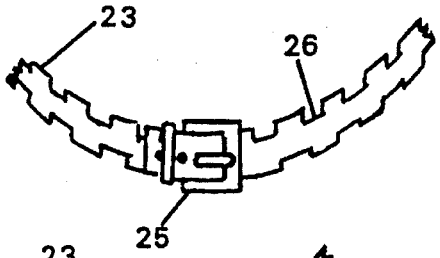
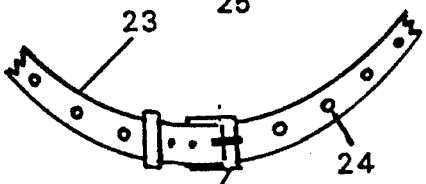
Fig.11b
Fig.10a
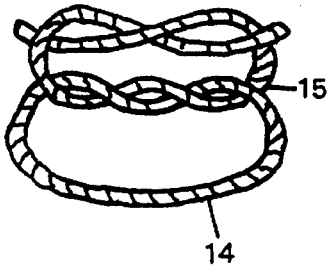
Fig.12
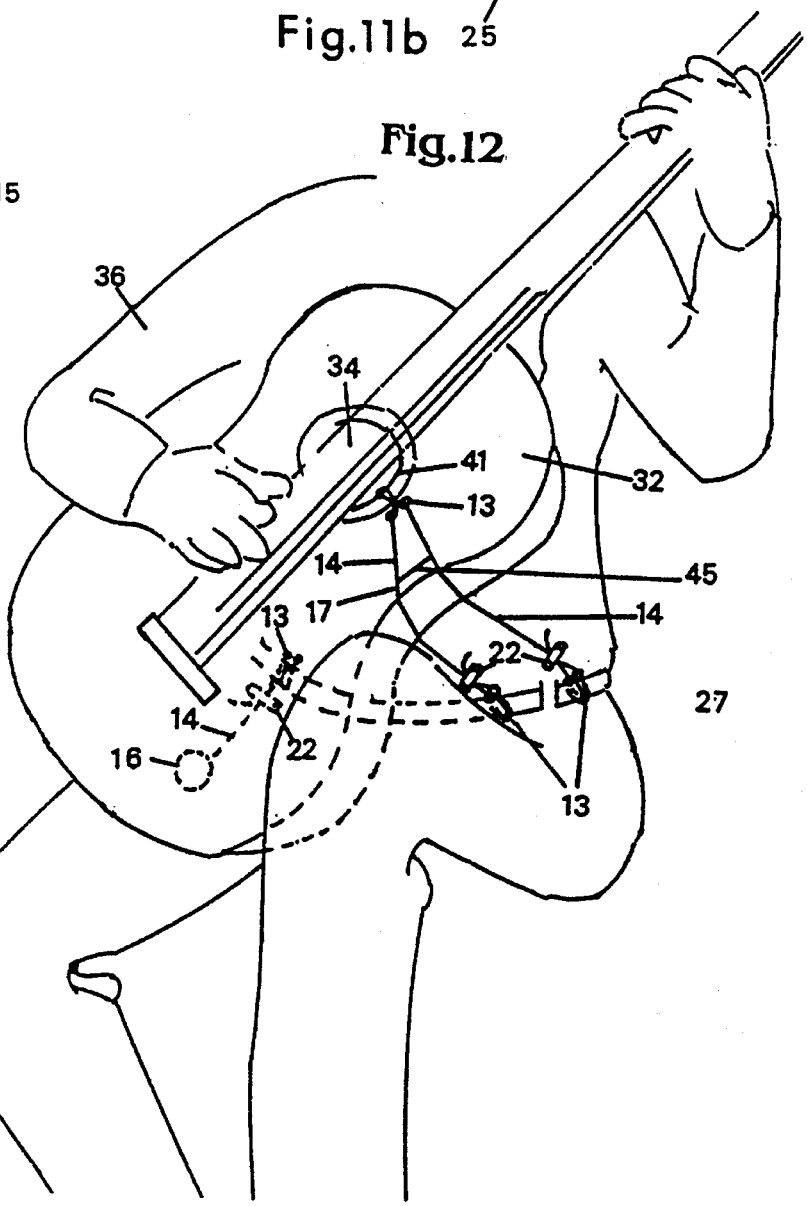
Fig.9g
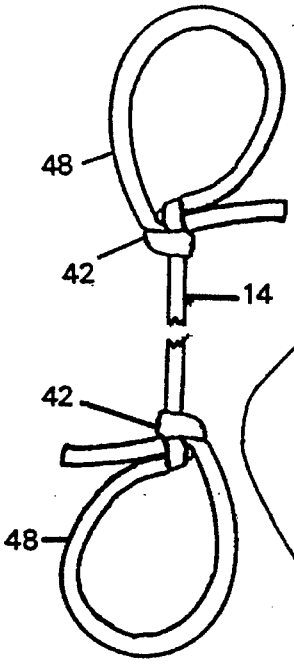

SITTING POSITION MUSICAL INSTRUMENT RETAINER

BACKGROUND-FIELD OF INVENTION

This invention relates generally to the art of music and more particularly to an apparatus for retaining a musical instrument such as a guitar when the musician is in a sitting position.

BACKGROUND-DESCRIPTION OF PRIOR ART

Players of held musical instruments such as a guitar have always had a fear of dropping the instrument; and this fear is a complicated mixture of physical, psychological, and aesthetic elements. Moreover, this fear of dropping the instrument is undoubtedly one of the causes of stage fright and poor playing technique that has not been adequately explored previously. And this is true even in the sitting position where a musical instrument such as a guitar is balanced somewhat precariously on a player's leg. This problem is exacerbated when the player moves around by leaning and stretching to play an instrument better. These body movements tend to make a guitar slip forward at the point of contact with the leg from the thigh towards the knee.

This problem is made worse by a player tilting an instrument back to better see the playing area. This tilting back enables a player to play and see better, but makes a guitar even more likely to slip out of position.

This sliding away tendency of an instrument is made worse by the weight of a player's arm resting on and pushing down on top of an instrument. This weight of the player's right arm also causes the guitar to be twisted to the right. By the same token the grasping and pushing tendency of the player's left fingers sometimes turns and twists the guitar to the left. A further aggravating factor with this sliding and twisting is that certain guitars, lutes and mandolins have rounded bodies that make them even more likely to scoot forward and slip around. Also, some electric guitars come in unusual shapes that make them unwieldy in the sitting position.

This sliding problem also causes bad playing technique. The problem is bad enough that certain primitive playing techniques still persist on guitar-like instruments, such as keeping the right hand little finger on the face of an instrument while playing with the other fingers and thumb. This helps steady the instrument, but locks the right hand into only one position, thereby drastically limiting the playing techniques available. Other bad playing techniques persist such as grasping the neck of an instrument with the left hand to keep the instrument from slipping; rather than keeping the left hand in a more advantageous open and free position.

Thus a vicious circle is set up whereby the player puts extra weight on the right arm to resist the grasping and pushing tendency of the left hand; while simultaneously putting more grasping and pushing on the left hand to resist the weight of the right arm pressure. Ideally an instrument would remain securely in place with little or no pressure and grasping on either side. The extra weight of the right arm also creates another bad effect of slippage, namely that this extra weight of the right arm muffles the tone of an instrument. Since an acoustic guitar like musical instrument is usually not a very loud instrument anyway, this muffling of the already small sound can be very serious.

When an instrument is held on the left leg in the classical playing position, there are the problems already stated. When an instrument such as a guitar is held on the right leg as in folk music playing, there is also a bad lateral movement. The far right position of the player's right arm pushes the body of an instrument backward causing the neck of the instrument to swing forward twisting and turning the instrument to the right. This lateral movement causes the same type of problems as the forward slippage such as the left hand grasping the neck of the instrument to keep it from swinging forward. Moreover, the preferred playing position is with the neck of the instrument slightly back with the right end of the instrument slightly forward.

Another aspect of this instrument slippage is that some singers accompany themselves on guitars and lutes in the sitting position. The tension caused by an instrument slipping around can have a bad effect on their singing technique and posture.

Therefore there has always been a need to retain a guitar in a constant relationship with a player's body, without slippage. Furthermore there has always been a need for a grasping or tying apparatus for a guitar held in a sitting position that offers a high level of security and convenience without permanently modifying or adding appurtenances to an instrument. In addition, there has always been a need for a retaining device designed for use in the sitting position, but which remains in place while a musician is in other positions such as standing, walking and bowing, as in a performance. Finally, there has always been a need for a retainer that uses light and thin materials that will not muffle an instrument's tone. While a variety of musical instrument retaining and support apparatuses have been provided for the standing position, there have not been any that are expressly designed for the sitting position. While not being a retaining device, the pad holder of Haille, U.S. Pat. No. 672444, is designed to slow slippage with a soft pad, but does not have any way of locking an instrument in a set position.

While it might be argued that neck straps could be used for the purpose of retaining a guitar in the sitting position, they are primarily designed for use in the standing position. For the sitting position their fulcrum is in the wrong place. If a sitting player leans forward the strap will go slack. If he leans backwards the instrument will be jerked up. Also neck straps have to be built heavily to support the downward weight of an instrument. In the sitting position an instrument rests on the player's leg and there is little weight to be resisted in the sliding; therefore a sitting position retainer can be built of extremely light and thin non-muffling materials.

Another annoyance with neck straps is that the pull on the back of one's neck can distract one's attention from a performance and increase fatigue. A further drawback with neck straps is that there is noway of locking the preferred forward and lateral angles of playing into place in the sitting position.

U.S. Pat. No. 4,251,016 to O' Rafferty discloses a stringed instrument harness that exhibits many of these flaws. The heavy duty webbing used to cradle an instrument are in contact with its sound board and would muffle its tone especially since they are under. Also, this harness is clearly designed as a neck strap whose fulcrum is in the wrong place resisting a downward rather than a forward momentum. U.S. Pat. No. 5,431,320 to Hash shows another neck strap that would give no control whatsoever in the sitting position. In the sitting position, neck straps (also called shoulder straps) cause more problems than they solve. This is because the fulcrum of control is in the wrong place, that is they are too high.

U.S. Pat. No. 2,273,136 to Orech and U.S. Pat. 3,366,293 to Fyke disclose another form of neck strap that travels under the guitar and up, hooking into the sound hole of an instrument. While these might resist some forward motion, they would still have the problems of slackness and jerking caused by a player's leanings. Also they could not be used with electric instruments that do not have a sound hole.

U.S. Pat. No. 3,037,416 is a neck strap with a belt adapter. While this belt adapter would resist forward motion it was not designed for this purpose, the purpose being to help support a heavy electric musical instrument in the standing position. Nevertheless it does have the good feature of being at least a little adjustable to help set a desired state of lean. But this belt adapter has another bad quality which is that it attaches to a screwed in connector on the front of an instrument. Most musical instrument owners would never mar the finish and look of their instrument which in itself is a work of art by screwing a connector into them. Also, on acoustic guitars, the wood on the front of the instrument is so soft the screw would tear out under a pressure. Since people would not be likely to use these marring devices it limits their utility.

U.S. Pat. No. 3,102,446 to Raleigh is a waist encircling belt which while it would resist forward slippage was not designed for this purpose being of heavyweight design to support a heavy electric instrument in the standing position. Also it uses marring screwed in or otherwise permanently attached connectors on the back of an instrument. These marring attachments would make it less likely that people would use it, but seem to be necessary when supporting an instrument in the standing position because of the angle of the forces acting on it and the heavy weight of most electric guitars. In addition, permanently mounted fasteners are bad because they don't allow any room for a player to improvise his own preferred attachment locations. Another bad feature of this invention is that it can't be used without the waist encircling belt. This style of belt might not be suitable for performers wearing period costuming. Also, this type of retainer is designed to keep the instrument tightly against the body. This tightness would make the sitting position difficult or uncomfortable.

Another waist belt retainer U.S. Pat. No. 5,069,103 to Healy is also clearly designed in the standing position. Its belt hook connector would make the sitting position impossible since it has no forward adjustability at all.

U.S. Pat. No. 3,371,570 to Lester is a strapless support means again designed for use in the standing position. While it would resist forward motion it has many problems such as keeping the guitar so close to the body that the player might not be able to sit down. Also since instruments like guitars come in many shapes its preformed aspect would make it relatively hopeless and would have to be custom built for an individual instrument adding high cost to its many other flaws such as not having any forward adjustability to allow for the advantageous leaning position. Also, since it is made out of hard materials it would probably rattle and buzz.

The bar like instrument stabilizer of Ivie, U.S. Pat. No. 3,955,461, is designed to support an instrument in an oblique plane for better viewing of the playing area. But it is designed for a player in the standing position. While it sets the forward angle of playing it does not control the lateral angle. Also it uses marring screwed in fasteners for the instrument and does not seem to have any adjustability to allow for experimentation with different angles. In addition its stiff construction would probably poke and annoy a player in performance.

Other guitar supporting devices such as U.S. Pat. No. 4,966,062 to Driggers and U.S. Pat. No. 1,945,162 to Rasmussen are primarily designed to elevate or cushion a guitar in the sitting position. They are fitted with slip retarding materials such as rubber at the point of contact with the human leg. However much they retard motion, they still do not lock an instrument in one position and if a player moves his trunk around a guitar can still slip forward on the leg causing unwanted angles of playing.

OBJECTS AND ADVANTAGES

Accordingly, several objects and advantages over prior art of my invention are:

(a) to provide a retaining and steadying device for playing a held musical instrument such as a guitar in a sitting position; said retainer stopping forward and lateral slippage and locking the instrument into the preferred playing angles;

(b) to provide a retaining device that is adaptable to all of the shapes and configurations of these instruments;

(c) to provide a tying arrangement that offers a high level of security and convenience without permanently modifying or adding appurtenances to an instrument, using an instrument's own sound hole lip, body or neck strap pegs as points of attachment;

(d) to provide a connector such as a hook that attaches over the lip of an instrument's sound hole, this connector being tied to a lightweight universally bendable, nonstretch linear structure such as a cord that runs across the face of said instrument downward. The free end of the cord then continues under the guitar and back to connect to a waist encircling belt; on the left front portion, from the player's point of view;

(e) to provide another alternative connecting system such as a suction cup that attaches to the right side of the body of an instrument. This suction cup is tied to a connecting cord whose free end runs back and attaches to the waist belt on the right front portion. Also, to provide another connecting system like a suction cup that attaches to the top left portion of an instrument's body. This suction cup is tied to a connecting cord whose free end runs down and attaches to the left front of the said waist belt;

(f) to provide a means of adjusting the length of the ends of these cords, such means being retying the knots used for attachment or using spring activated barrel locks to allow the player to set a proper distance from his trunk to the bottom of an instrument thereby achieving a suitable forward and lateral angle of playing;

(g) to provide a special one size fits all cincture style waist belt for the player to wear;

(h) to provide said waist belt with ease of tying and retying by using one hundred percent rayon;

(I) to provide another configuration that would have a connector such as a hook tied to a cord that would loop around the left peg on a solid body guitar like instrument and be regrasped by its own hook. The free end of the cord would run back and tie to the left front portion of a waist belt. This configuration would also include another connector such as a suction cup tied to a cord. This cord would loop around and grasp the right end peg of said solid body instrument with the suction cup attaching to the back of said instrument near the peg. The free end of this cord runs back and fastens by knot to the right front portion of the waist belt. Also in this configuration another connector suction cup tied to a cord would grasp the lower left front portion of said instrument's body. The free end of said cord runs back and attaches to the left front portion of the waist belt;

(j) to provide a retainer that is lightweight, inexpensive, easily massed produced, foldable, storable and made of appropriate materials that are durable, tough and that can stand up to long usage;

(k) to provide a retainer that can be produced in a variety of colors that give it a pleasing aesthetic look;

(l) to provide a retainer that can be adapted for use with devices such as the A-Frame, U.S. Pat. No. 4,966,062 and various guitar cushions;

(m) to provide a retainer with three holding points on the instrument giving it the strongest possible resistance, the triangular;

Further objects and advantages are to provide a retainer that can be used to stabilize guitars held in difficult sitting positions such as the flamenco style.

DRAWING FIGURES

In the drawings, closely related figures have the same number, but different alphabetic suffixes.

FIG. 1 shows the preferred configuration of a guitar retainer being used by a musician playing an acoustic guitar in the sitting position.

FIGS. 2*a* shows the preferred,configuration retainer; FIG. 2*b* shows a preferred variant to use with instruments with strap pegs.

FIGS. 3*a* and 3*b* show a side view and a top view of a player with the preferred acoustic instrument configuration.

FIG. 4*a* shows a top view of the preferred configuration guitar retainer for an electric guitar; FIG. 4*b* shows a preferred variant for use with an instrument with neck strap pegs. FIG. 4*c* shows a variant that uses two suction cups and three cords and hooks that grasp the player's own belt, with barrel locks to adjust string length.

Figure 1:
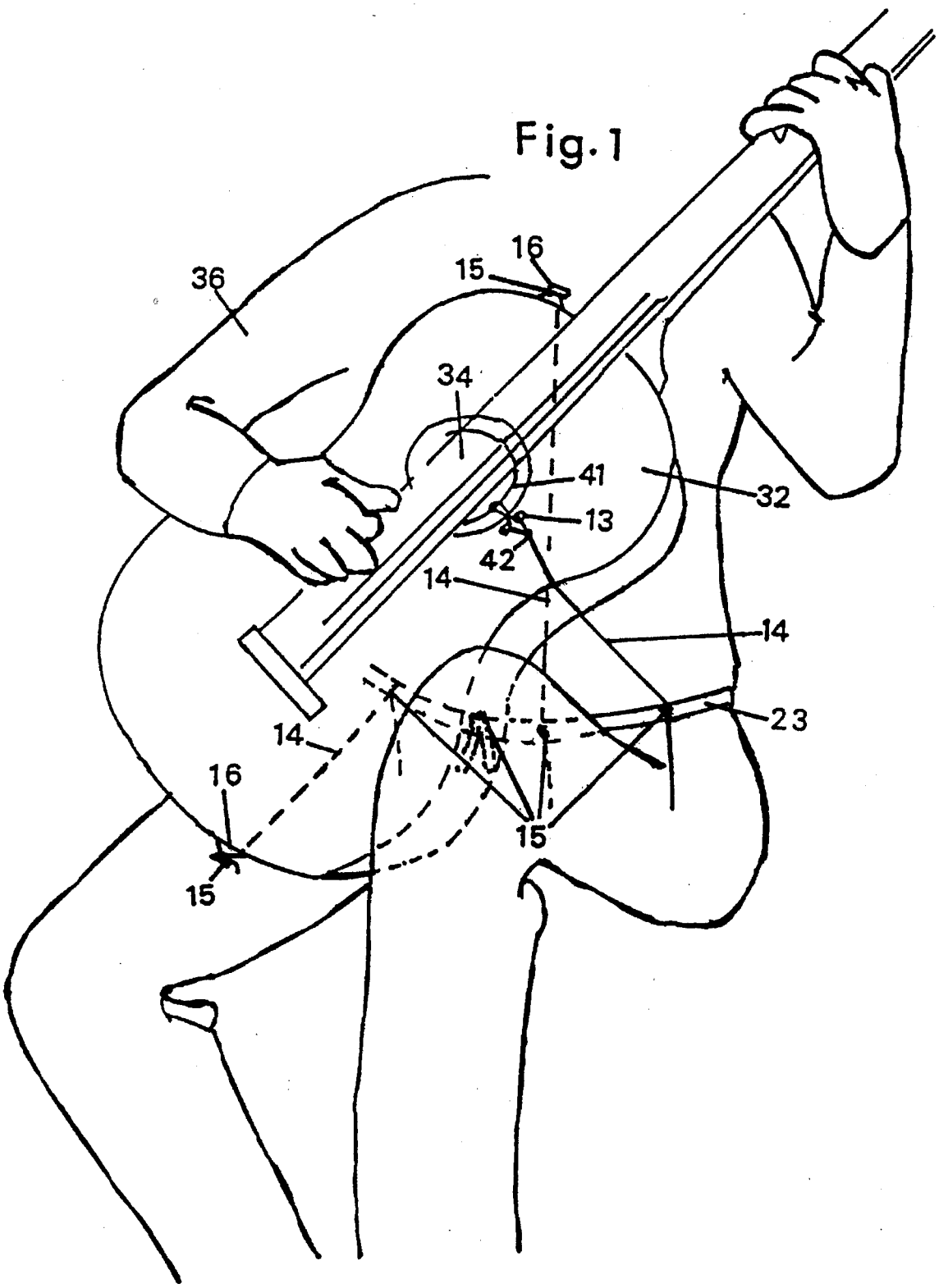

FIGS. 9*a* to 9*g* show some variant single cord embodiments usable by themselves or in combination with other retainers.

FIG. 10*a* and 10*b* show how to tie the two kinds of knot used in the invention; a surgeon's knot and a bowline knot.

FIG. 11*a* and 11*b* show two possible alternative belts with premarked points of attachment.

FIG. 12 show a variant configuration usable with an acoustic guitar.

REFERENCE NUMERALS IN DRAWINGS

| | |
|---|---|
| 13 hook | 14 cord |
| 15 surgeon's knot | 16 suction cup |
| 17 acoustic retainer | 18 alligator style clip |
| 19 bowline knot retainer | 20 openable ring |
| 22 barrel lock | 23 provided waist belt |
| 24 hole in belt | 25 adjusting buckle |
| 26 notch in belt | 27 player's own belt |
| 28 player's clothing | 30 button hole |
| 32 acoustic guitar | 33 electric guitar |
| 34 sound hole | 35 face of instrument |
| 36 player | 37 player's arm |
| 38 lute | 40 A-Frame |
| 41 lip of sound hole | 42 bowline knot |
| 43 belt buckle | 44 back side of guitar |
| 45 spread resister string | 46 legs of A-Frame |
| 47 waist of guitar | 48 loop in cord |
| 49 neck strap peg | |

Description—FIGS. 1 to 12

A typical preferred embodiment of my invention of an instrument retainer used in the sitting position is illustrated in FIG. 1. A player 36 in the sitting position is holding an acoustic guitar 32. A hook 13 attached to the lip of the guitar sound hole 41 is fastened to a cord 14 with an appropriate knot such as a bowline knot 42. The free end of the cord 14 runs down the face of said guitar 35, then under the instrument back to a provided waist belt 23 to which it is connected by means of an appropriate knot such as a surgeon's knot 15. The distance from the guitar to the player can be adjusted by changing the length of the cord 14 by means of retying the knot 15. The hook 13 used on the lip of the guitar sound hole 34 in the preferred embodiment would be cloth covered to keep it from marring the finish of the instrument. Other types of usable hooks could be molded plastic, nylon or some such material provided that they have a smooth finish which would not scratch an instrument's finish. On the right side of the instrument a suction cup retainer 16 is attached. The suction cup 16 is tied to the waist belt 27 with a cord 14. Adjustability of the cord 14 length is provided by retying the attaching knots. This suction cup 16 retainer assists with lateral control. The free end of the cord 14 is attached to the front right side of the waist belt 23.

Another suction cup 16 is attached to the top left part of the instrument's 32 body; it is tied to a cord 14 that connects it with the provided waist belt 23 by tying to it.

The cords 14 used in the preferred configuration can be of any flexible, tough, smooth and non-stretch material such as nylon; they can also be made out of other appropriate materials such as cotton, leather, or composites.

Figure 2A:
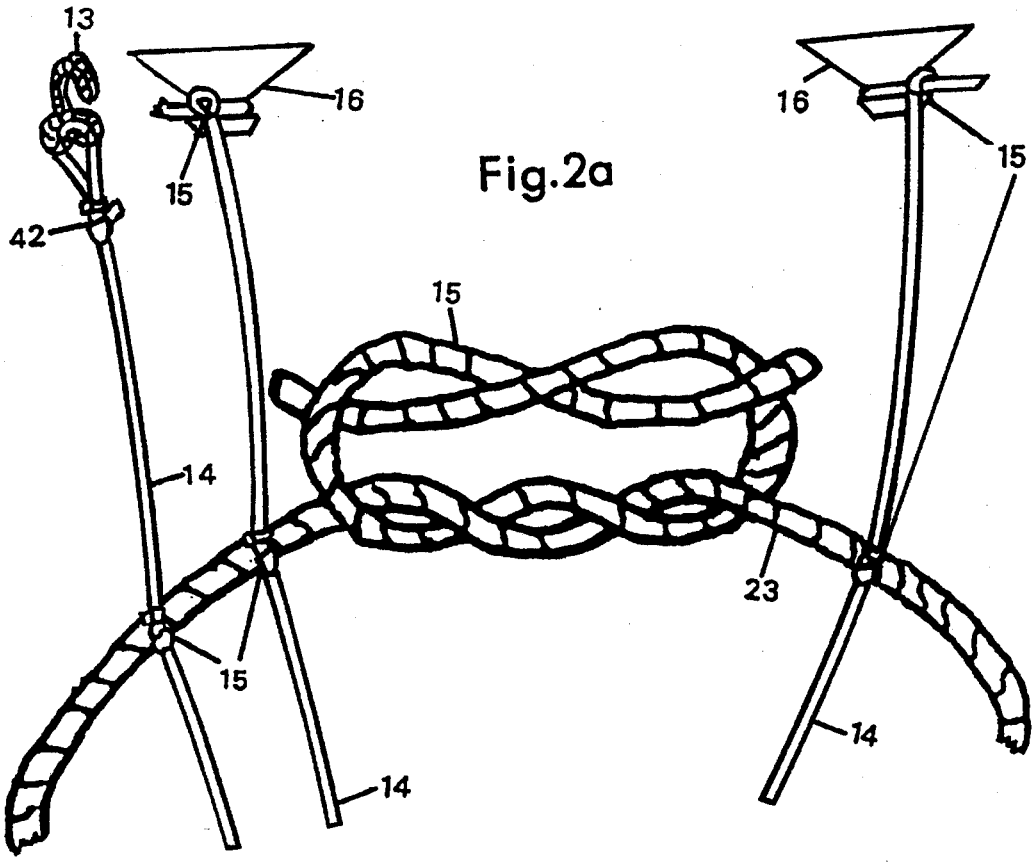
Figure 2B:
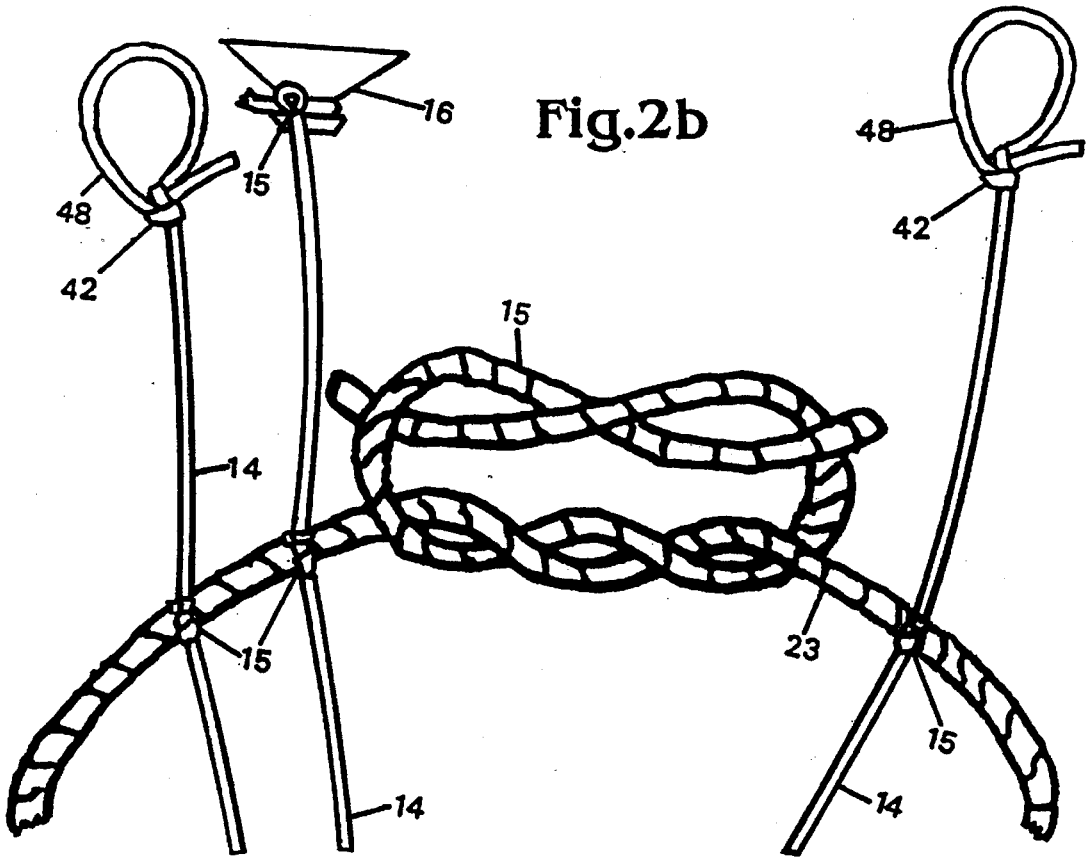

FIG. 2*a* shows the preferred configuration retainer. FIG. 2*b* shows the preferred retainer adapted for instruments with strap pegs.

Figure 3A:
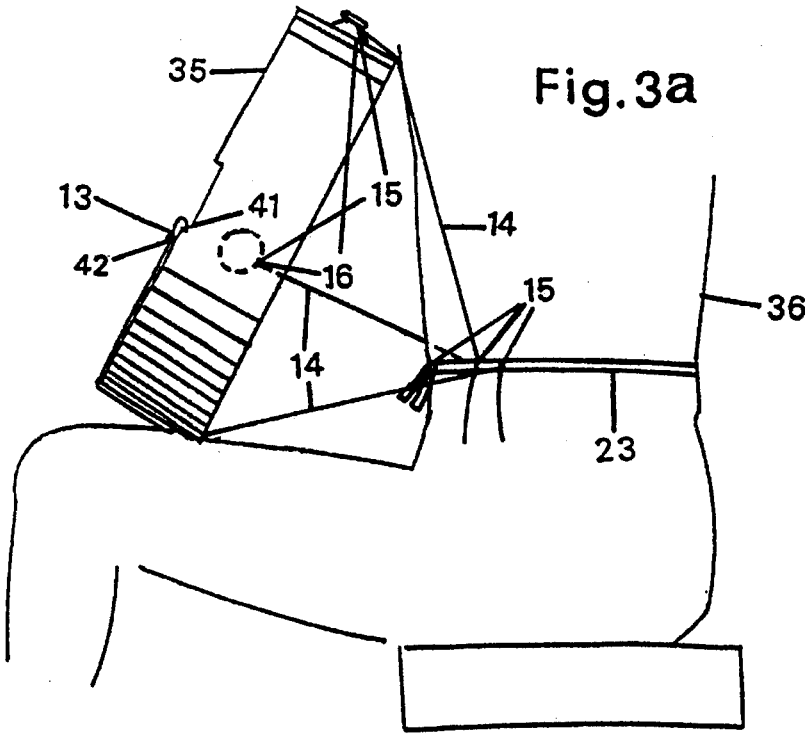
Figure 3B:
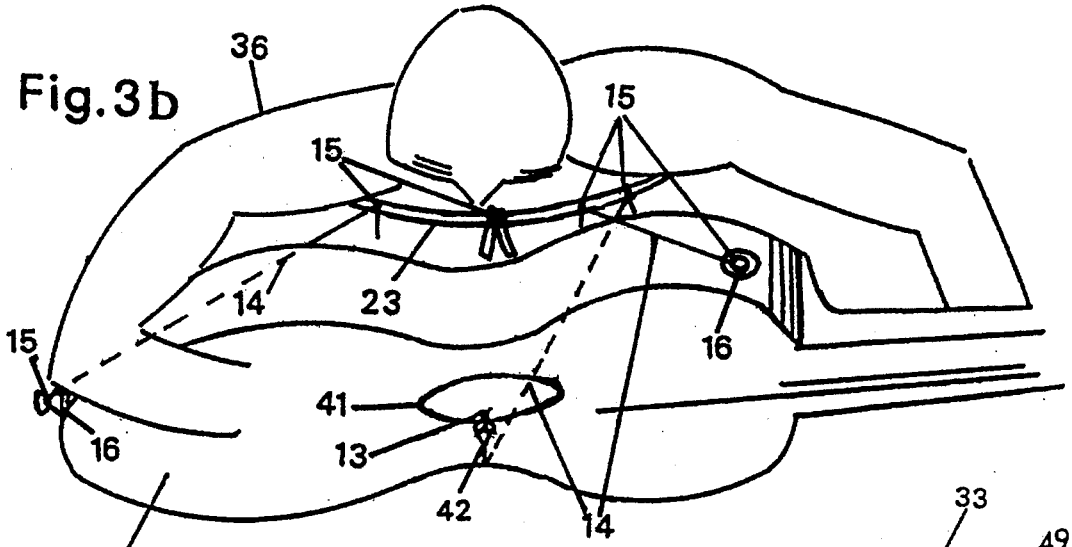

FIG. 3*a* shows a side view and FIG. 3*b* shows a top view of the preferred retainer.

Figure 4A:
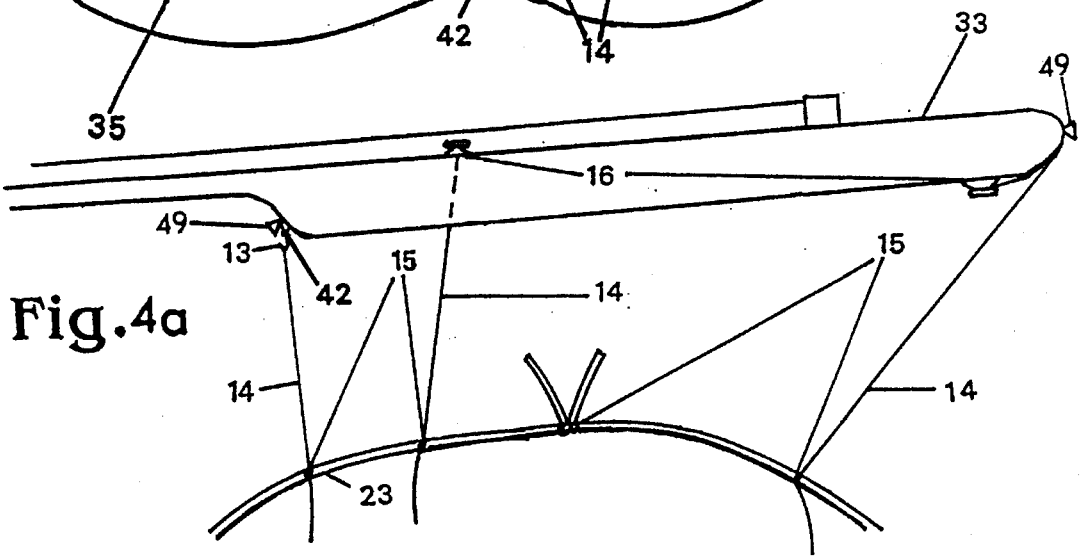

FIG. 4*a* shows a preferred embodiment of a player 32 using an electric guitar 33. Since most solid body electric guitars 33 do not have a sound hole 34, a suction cup 16 connector attaches to the right back end of the instrument's body after looping its connecting cord 14 around the right end peg 49 of the instrument 33. The free end of the cord 14 then runs back and ties to the right front side of a waist worn belt 23. Another suction cup 16 attaches to the lower left front of the solid body of the instrument 33. Its connecting cord 14 runs under the guitar 33 and back to tie by a surgeon's knot 15 to a waist belt. The cord 14 with the hook 13 attached to it loops around the left peg 49 of the instrument 33 and the hook grasps its own cord 14. The free end of the cord 14 runs back to tie to the left front portion of the waist belt 23. The length of the cord ends 14 is adjusted by means of retying the connecting knots.

FIG. 4*b* shows a variation of the preferred configuration. The right suction cup has been untied and removed from the cord 14. Replacing it is a loop 48 created by tying a bowline knot 42 on the cord 14. This loop 48 is used to grasp the right end peg 49. Also in this variant the covered hook 13 is also removed and replaced by another loop 48 created by another bowline knot 42. This loop 48 is now used to grasp the left peg 49 of the instrument 33.

FIG. 4*c* is a variant that uses two suction cups 16, three cords 14, and belt grasping hooks 13 that connect to a player's own belt 27. Barrel locks 22 are used to adjust the cord 14 length, and therefore the distance between the player and the instrument.

Figure 5:
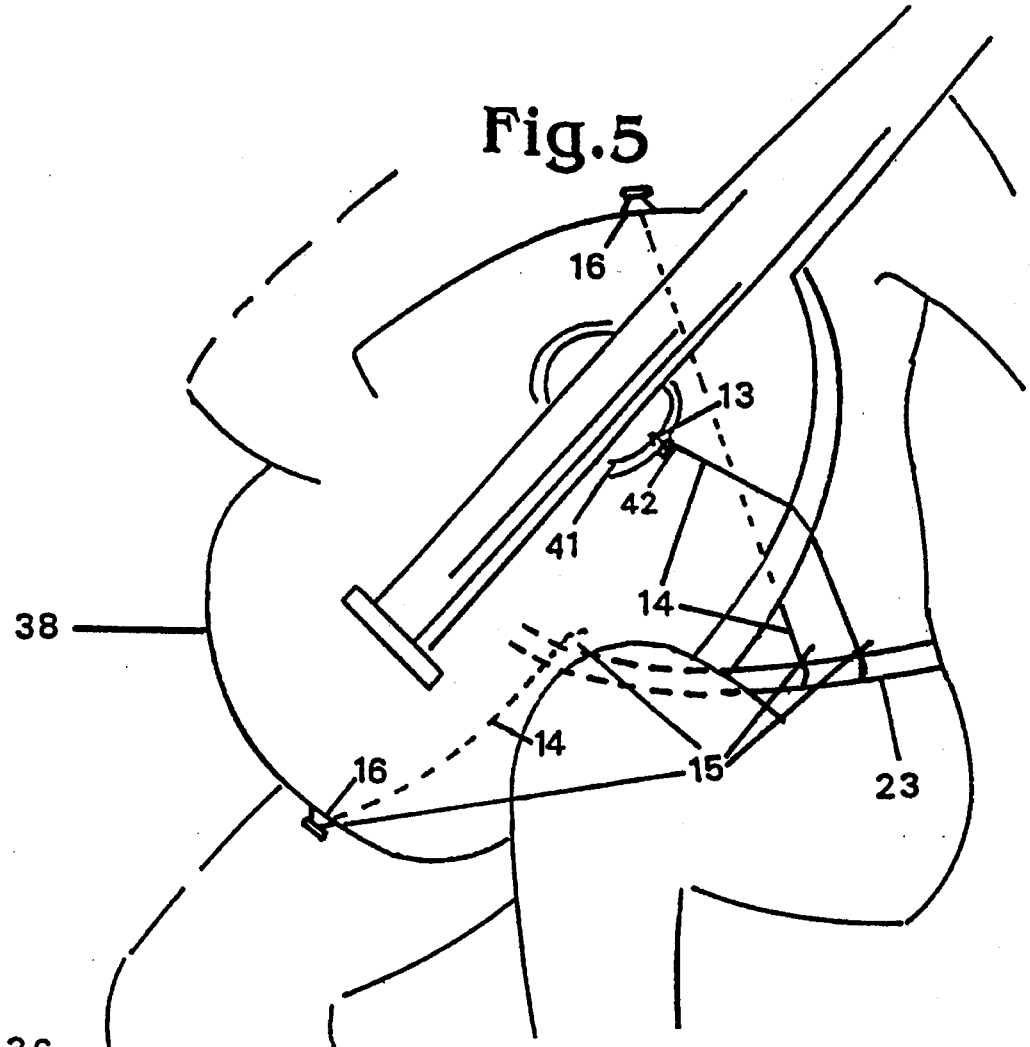
FIG. 5 shows a preferred configuration retainer used with a rounded bodied instrument such as a lute.

FIG. 5 shows a preferred configuration being used with a round bodied instrument such as a lute 38.

Figure 6:
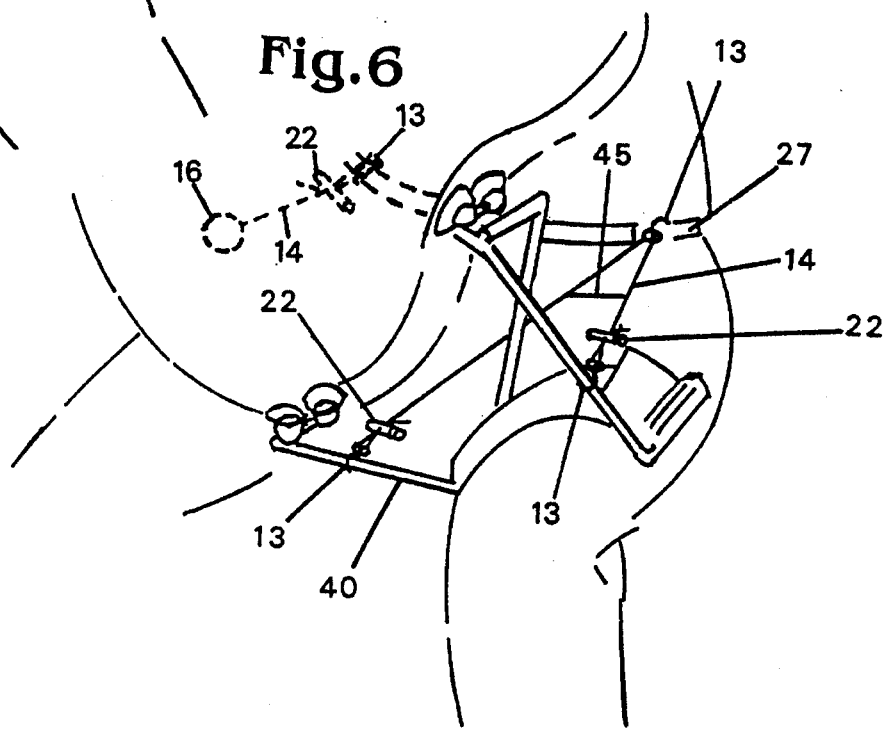
FIG. 6 shows a variant configuration usable with a guitar attached to an A-Frame.

FIG. 6 shows a variant configuration being used with a guitar A-Frame 40 attached to an acoustic guitar 32.

Figure 7:
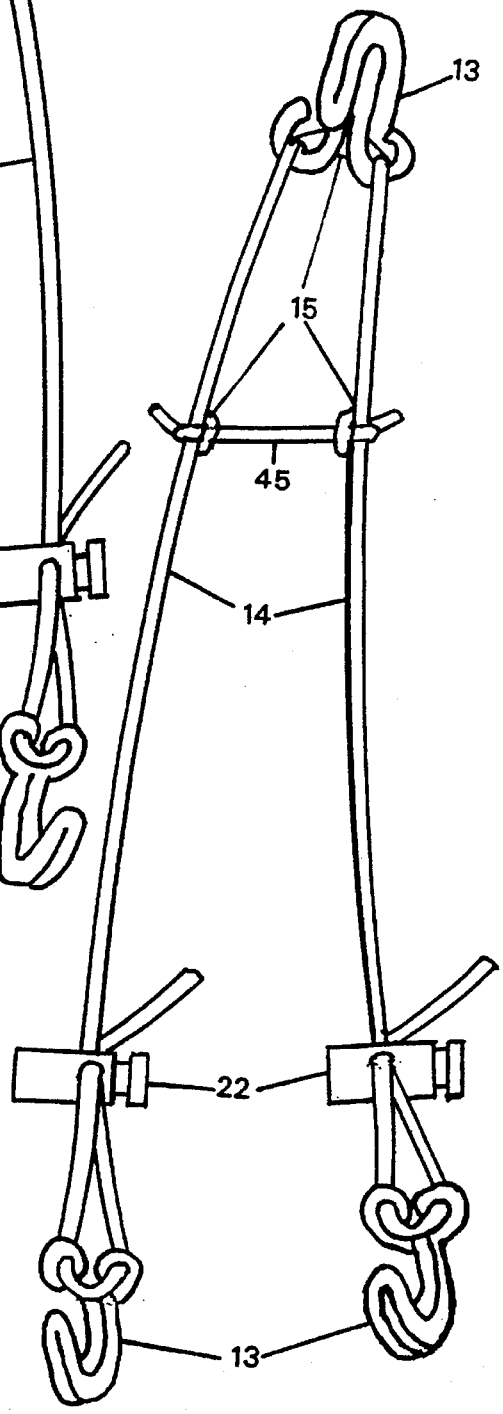
FIG. 7 shows a possible variant of a hook type acoustic instrument retainer.

There are various possibilities with regard to the type of hooks 13, cords 14, suction cups 16, other clothing connectors such as alligator clips 18, or openable rings 20 and adjustment devices such as barrel locks 22, buckles 25 or retying square 15 and bowline 42 knots used with the preferred configuration and variants which don't use a provided waist belt FIG. 7 shows a variant configuration where the hook 13 is tied to two cords 14 that run back to the player's own belt, one to the left side and one to the right side. The cords 14 are kept from spreading too far apart by a spread resister string 45 that holds the two cords 14 together approximately three inches from the hook 13. The cords 14 are connected to the player's own belt 27 by means of hooks 13 on the end of said cords. Barrel locks 22 on the cords provide adjustability. This variant has the advantage that it controls both forward and lateral slippage with just one connector, the sound hole lip 41 hook 13.

Figure 8:
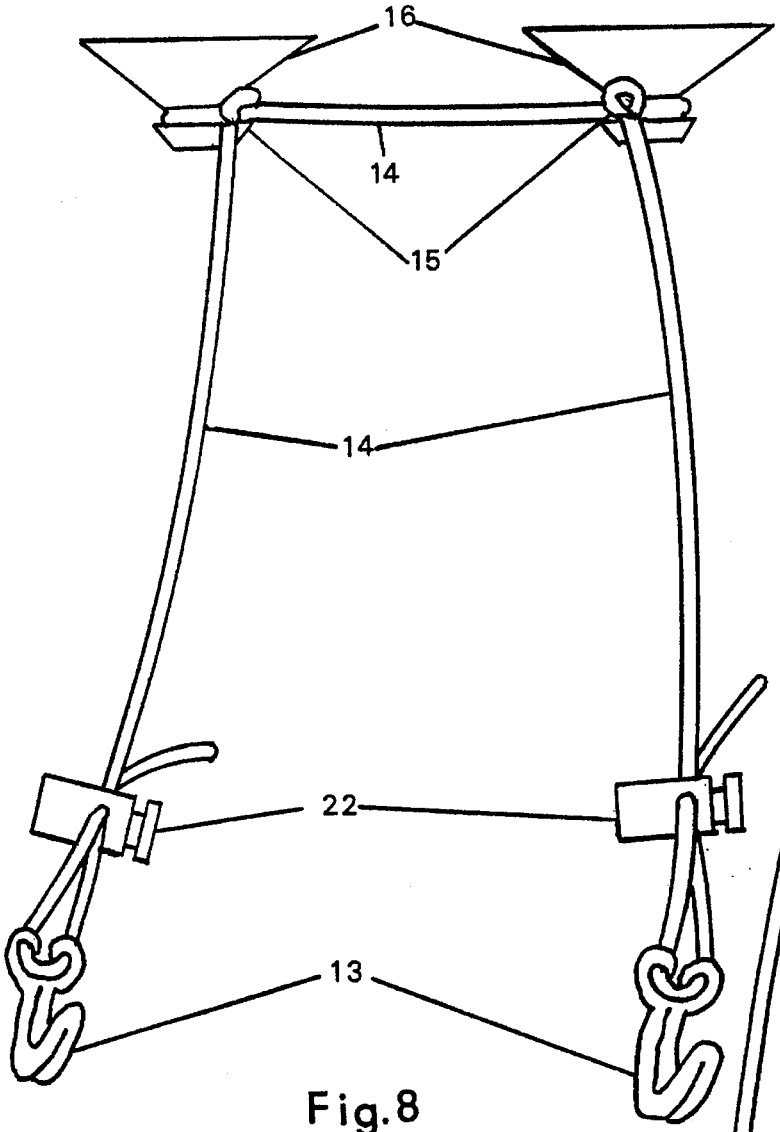
FIG. 8 shows another possible variant style retainer.

FIG. 8 shows another variant possible with two suction cups 16 that grasp the back of an instrument. These two suction cups 16 are connected together with one of the cords 14. Each suction cup 16 is then connected to another cord 14 that runs back to the player's own belt 27 to which they are connected by a provided hook 13, with barrel locks 22 providing cord 14 length adjustability. The left suction cup's 16 cord 14 runs back to the left side of the player's own belt 27; and the right suction cup's 16 cord runs back to the right side. In this way forward and lateral stability are provided.

Figure 9A:
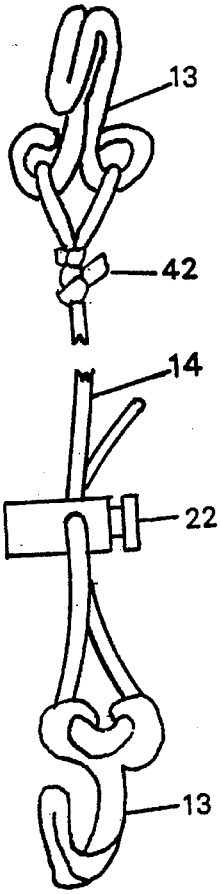
Figure 9B:
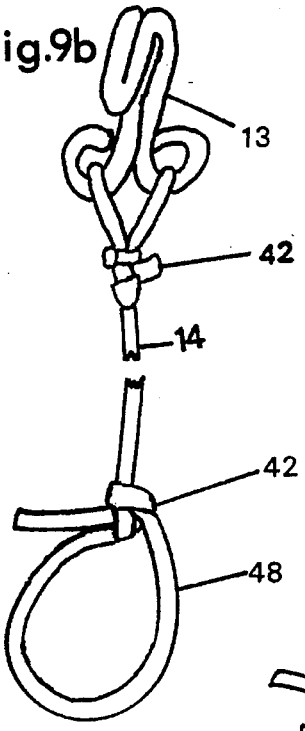
Figure 9C:
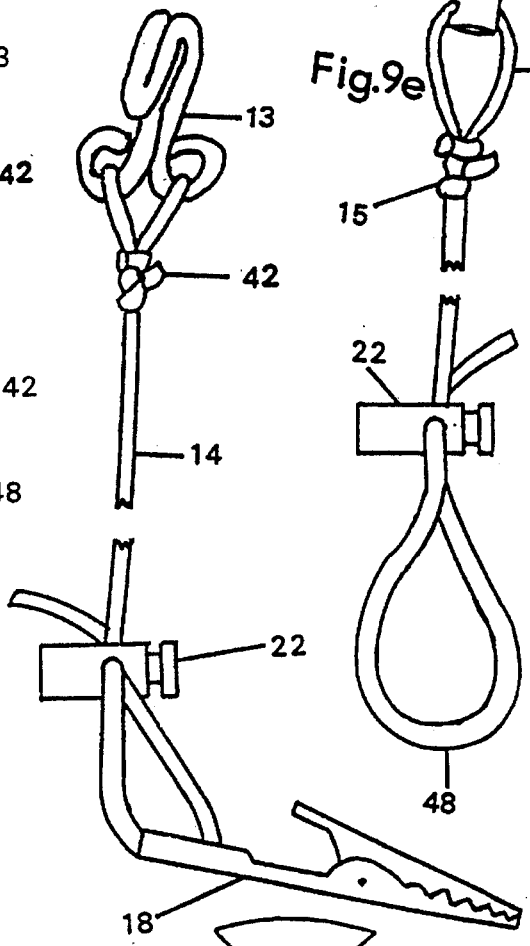
Figure 9E:
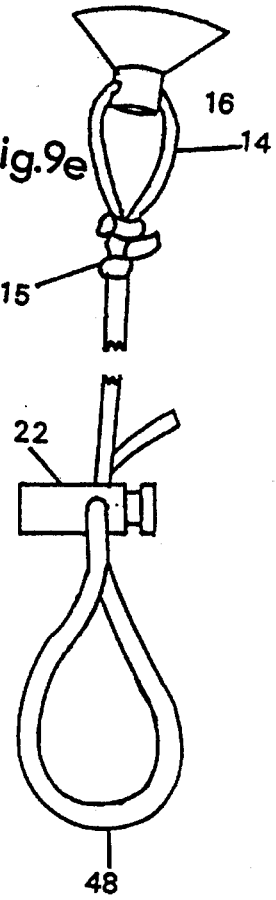
Figure 9D:
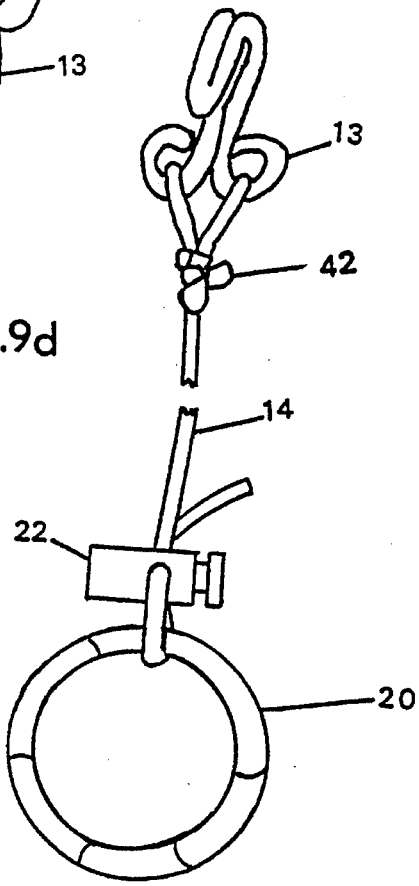
Figure 9F:
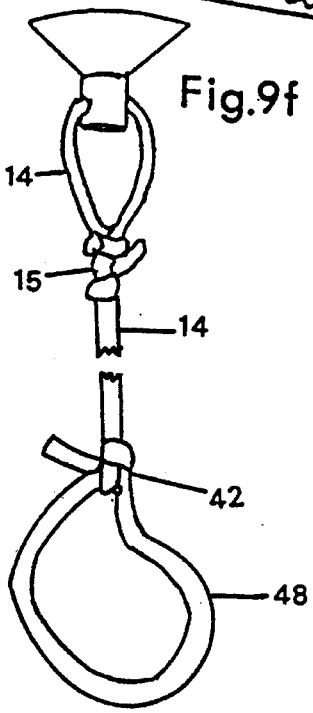

FIGS. 9*a* to 9*g* show some possible embodiments of a variant simplified guitar retainer adaptable from the parts of the preferred configuration. To achieve both forward and lateral adjustment a player could use two or three of these simple variants; another way to achieve lateral and forward control with one of these is to angle it back to the left or right side of the player's belt. One embodiment, FIG. 9*a*, shows the use of a hook 13 connected by means of a cord 14 to another hook 13 with the cord 14 being adjustable in length by means of a barrel lock 22. FIG. 9*b* is a possible configuration used with electric instruments. On the instrument end it has a loop 48 formed by a bowline knot 42 which attaches to the instrument's neck strap pegs 49. A clothing gripper hook 13 is on the other end of the cord 14 with a barrel lock 22 providing adjustability. FIG. 9*c* uses an alligator clip 18 to connect to the player's clothing. The alligator clip 18 can be substituted when a player 36 is not wearing a belt 27. FIG. 9d substitutes an openable ring 20 for the belt hook 13. The ring 20 could be used with the provided belt 23 or the player's belt 27 or could be used with a button hole or a loop in the player's clothing. This invention has the advantage that these substitutions would require no tools. The barrel lock 22 would be opened releasing the fastener from the cord 14; a new fastener would be put on the cord 14 and locked on place with the barrel lock 22. FIG. 9*e* shows a belt connector created out of the cord 14 itself by reversing its direction in a loop and rerunning itself through the barrel lock 22 in the opposite direction. In this 9*e* configuration the hook 13 has been replaced by a suction cup 16. Although this invention obviously has the advantage that it can be produced cheaply, configuration 9*e* is an especially inexpensive alternative. FIG. 9*f* shows an even more frugal adaptation where the cord's 14 loop is created by means of a surgeon's knot 15 replacing the barrel lock 22. Although these barrel locks, extra hooks, alligator clips and rings are not part of the preferred configuration, they could be used by those that want them for a more high tech look.

FIG. 9*g* is a cord 14 that has bowline knots 42 on both ends.

FIG. 10*a* and 10*b* show how to tie a surgeon's knot 15 and a bowline knot 42.

FIG. 11*a* and 11*b* show other types of provided belts that can be used. These belts have clearly marked points of attachment for the connecting cords 14. These attaching points can be such things as notches 26 or holes 24 in the belt 23.

FIGS. 12 shows the FIG. 7 variant and a FIG. 9 variant being used with an acoustic guitar 32.

From the description above a number of advantages of my musical instrument retainer become evident:

(a) A main advantage of my instrument retaining device is that it is effective in reducing the forward and lateral slippage of musical instruments while a player is in the sitting position. By reducing this slippage it eliminates a major cause of stage fright and poor playing technique. In this way my retainer creates security and eases tension by making an instrument such as a guitar into a secure foundation to play upon rather than a slippery bed of unexpected variables. This frees the player's hands to play rather than support the instrument. The light playing pressure now possible with the right arm and left hand greatly reduces fatigue and soreness.

(b) Another advantage of a retaining device such as mine over a supporting device is that a retaining device can be made much lighter and inexpensively. This is because a retainer does not have to support the downward pull of the weight of an instrument, being designed for use in the sitting position.

(c) Because the fasteners of the retainer do not have to resist much weight, they do not have to be permanently installed with unsightly marring devices such as screwed in fasteners or fasteners permanently affixed by bonding or gluing.

(d) Because of the small resistance factor the connecting cord 14 can be thin enough to be barely visible to an audience.

(e) The entire retainer only weighs a few ounces and is scarcely noticeable to an audience in a performance.

(f) The retainer's small size when folded up would permit it to be carried in the small accessory slot that is in most musical instrument carrying cases.

(g) All of the parts of the different configurations are quickly and easily adjustable without the use of tools allowing a player to experiment with different embodiments.

(h) The provided belt is helpful for those who normally don't wear belts, and is quick and easy to attach; also, its one hundred per cent rayon construction makes it is easy to tie and untie.

(I) This retainer also uses three retaining locations for the strongest possible connection, the triangular.

Operation—FIGS. 1–12

The manner of using the musical instrument retainer is to attach fasteners to an instrument and connect these fasteners to a waist worn belt 23 by means of cords 14. In the preferred acoustic embodiment a hook 13 is attached to the lip of a guitar sound hole 41. A cord 14 is attached to this hook 13 with an appropriate knot such as a bowline knot 42. The free end of this cord 14 then runs under the instrument 32 and back and ties to a provided waist belt 23 with an appropriate knot, such as a surgeon's knot 15. The vertical slope and lateral angle of the instrument 32 is adjusted to the preferred setting desired by the player 36 by means of lengthening or shortening the cord end 14 by means of retying the connecting knots.

The preferred acoustic configuration also includes a suction cup 16 retainer on the right side of the instrument 32 for additional support. The suction cup 16 is tied to a cord with an appropriate knot, such as a surgeon's knot 15. This cord 14 runs back and attaches to the left front side of the belt 23 with an appropriate knot such as a surgeon's knot 15.

Another suction cup 16 is attached to the top left side of the instruments 32 body. It is tied to a cord 14 with an appropriate knot, such as a surgeon's knot 15. The free end of the cord 14 then runs back and ties to the front left portion of the waist worn belt 23 with an appropriate knot such as a surgeon's knot 15. The connecting knots can be retied to allow adjustability.

The preferred configuration for an electric guitar 33 uses a hook 13 tied to a cord 14 with appropriate knot, such as a bowline knot 42. The cord 14 loops around the left peg 49 and grasps itself with the hook 13. The free end of the cord 14 runs down and ties to the left front part of a waist worn belt 23 with an appropriate knot, such as a surgeon's knot 15. Also used is a suction cup 16 tied to a cord 14 with an appropriate knot. This cord 14 is looped around the right peg 49 of said instrument 33 with the suction cup 16 grasping the right back side of the instrument close to the peg 49. The free end of the cord 14 then runs back to tie by appropriate knot, such as a surgeon's knot 15 to the waist belt 23 on the right front portion. Another suction cup 16 is used tied to a cord 14 with appropriate means, such as a surgeon's knot 15. This suction cup 16 attaches to the left lower front of the instruments body. The free end of the cord 14 runs under the guitar and back to tie to the left front side of the waist belt. Adjustability is achieved by retying the knots connecting the cords 14 and the waist belt 23.

A preferred variant configuration for electric instruments substitutes a loop 48 created by tying a bowline knot 42 and substituting this loop 48 for the hook 13. This loop 48 is used to grasp the left peg 49 of an electric guitar 33. The free end of this cord 14 then runs back to tie by knot to a waist worn, one size fits all, waist belt 23. A loop 48 created by a bowline knot 42 in a cord 14 also substitutes for the right suction cup 16. This loop 48 grasps the right end (butt end) of the instrument 33. The free end of this cord 14 runs back to tie by knot to the right front side of said waist belt 23. The other suction cup 16 attaches to the left lower front portion of the instrument's 33 body. This suction cup 16 is attached to a cord 14 by an appropriate knot. The free end of the cord 14 runs under the instrument 33 and back to tie to the left front of the waist belt 23.

In FIG. 7 we see another variant that can be used with a player's own belt 27. This variant only uses one instrument gripper, the sound hole grasping covered hook 13. This hook 13 is tied to two cords 14 with appropriate knots such as a surgeon's knot 15. The left cord's 13 free end runs under the instrument and back to the player's own belt 27 where it connects by means of a hook 13. Adjustability is provided by means of a barrel lock 22. In like manner, the right cord's 14 end runs under the guitar and back to the right side of the player's own belt 27. It ties to said belt 27 by means of a provided hook 13 with a barrel lock 22 providing adjustability of the cord 14 length. FIG. 12 shows this type.

FIG. 8 shows a possible variant that uses two suction cups 16 that grasp the back of an instrument, one on the left and one to the right. The two suction cups 16 are tied together by a cord 14 whose two ends tie to the suction cups by appropriate means such as a surgeon's knot 15. Another cord 14 ties to the left suction cup 16 in like manner. This cord's 14 other end is connected to the left side of a player's own belt 27 by means of a provided hook 13o The length if this cord 14 is adjusted by means of a provided barrel lock 22. In the same way another cord 14 ties in like manner to! the right suction cup 16. This cord's 14 free end runs back to connect to the right side of said player's own belt 27 by means of a hook 13. A barrel lock 22 again provides adjustability of the cord 14 length. FIG. 4*c* shows this configuration used with an electric guitar.

Another variant configuration is shown in FIG. 9*a* where an instrument gripper hook 13 is connected to one cord 14 running down the face of an instrument 35, then under it and back to grip a player's own belt 27 with a hook 13. The cord's length 14 is adjustable by means of a barrel lock 22. This retainer is angled back to the left or right side of the player's belt 27 to resist lateral as well as forward slippage.

FIG. 10*a* shows how to tie the surgeon's knot 15. FIG. 10*b* shows how to tie a bowline knot 42.

FIG. 11*a* and 11*b* show two possible other kind of belts that could be provided. FIG. 11a uses notches 26 to mark location points for the cords 14. FIG. 11*b* uses evenly spaced holes 24.

The slippage to be stopped will always be in a direction away from the player's body. This is because the player's body is in the way of backward motion and the weight of the player's arm pushing down on the guitar's body always propels it away from the body. When a player holds a guitar on the right leg there is also some lateral slippage with a turning of the face of the to the right. That is why it is preferable to retain the instrument with a compound arrangement of hook 13 style and suction cup 16 style retainers whenever possible in a triangular concept. The compound arrangement distributes the forces more evenly with the pull of the instrument being on three connectors instead of one or two.

When a musician is finished playing he can remove the hook 13 from the sound hole 34 easily by lifting it out since it does not have to fit tightly.

All of the other configurations of the retainer are easy to remove from an instrument after playing. The small size and weight of these retainers make them easy to put on or take off of the instrument.

Suction cups 16 are also easily installed and removed. The removal merely entails lightly sliding one's fingernails under one side and gently peeling them back. The size of the loop 48 used with neck strap pegs 49 on electric instruments can be adjusted in tightness by retying the bowline knot 42. When the player is walking on stage or standing and bowing the retaining device can remain in place with the player supporting the weight of the instrument with his hands. The light weight features and advantages of these retainers are mainly usable in a sitting position.

SUMMARY, RAMIFICATIONS AND SCOPE

Accordingly the reader will see that the musical instrument retainer of this invention can be used to retain a musical instrument such as a guitar at the proper forward and lateral angles easily and conveniently, can be installed and removed just as easily without tools or damage to the instrument and can be used with many different types of instruments with minimal changes to the retainer and no changes or modifications necessary to the instrument.

In addition, since it uses a tied on cincture style waist belt it fits with any clothing or costumes. Furthermore the instrument retainer has the additional advantages in that it permits the production of a preferred hook and suction cup style retainer which can be used for acoustic instruments;

it allows for a simply achieved variant suction cup retainer in conjunction with a bowline knot retainer usable with electric instruments;

it is also usable with an A-Frame or usable in a variant one cord configuration;

it can also be produced as a kit of interchangeable parts that can be adapted to the needs of the individual player;

it permits of easy adjustment, modification, installation and removal without the use of tools and with no marring additives to the instrument;

aesthetically it allows for a wide variety of possible colors and styles;

it provides a retainer that is extremely light, yet solid for its use;

it provides a retainer that provides long use and durability;

it provides a retainer that can be produced cheaply and easily with very little if any special tooling.

Although the description above contains many specifics, these should not be construed as limiting the scope of the invention, but as merely providing illustrations of some of the presently preferred embodiments of this invention. For example a thin strap could be used in place of a cord; this thin strap configuration could use Velcro for adjustment instead of retying a knot; the provided belt could have preinstalled eyes to be used with the cord's hook in a hook and eye configuration; the simple cord and the waist worn belt could be replaced with decorative macramé or webbing. The directions left and right in the descriptions are for a right handed player playing in a right handed position; for a left handed player playing left handed, all directions would be reversed. These retainers are all reversible for use by left handed players with no modifications necessary.

Thus the scope of the invention should be determined by the appended claims and their legal equivalents rather than by the examples given.

I claim:

1. A sitting position adjustable musical instrument retainer with a waist worn retaining belt attached to a musical instrument of the guitar family, comprising:

a) a waist belt having a first end and a second end including means for attaching said belt about one's waist to which the following are fastened:

b) a short cord having a first end and a second end; said first end having means such as a knot for adjustably attaching to the right front of said waist belt; with said second end attaching by appropriate knot to a suction cup, used for attaching to the right side of said instrument's body;

c) another short cord having a first end and a second end: said first end having means such as a knot for adjustably attaching to the left front of said waist belt; with said second end of said cord attaching by appropriate knot to a hook, used for attaching to said instrument's sound hole lip;

d) another short cord having a first end and a second end; said first end having means such as a knot for adjustably attaching to another spot on the left front of said waist belt; with said second end attaching by appropriate knot to a suction cup which is used to attach to the top left side of said musical instrument's body.

2. The retainer of claim 1 wherein said waist belt is a fabric rope, such as 100% rayon, approximately one quarter inch in diameter; and long enough to be one size fits all, approximately 64 inches; being tied around one's waist with a surgeon's knot.

3. The retainer of claim 1 wherein said hook used is an approximately three quarter inch fabric covered hook which is tied to said connecting cord by a bowline knot.

4. The retainer of claim 1 wherein said suction cups are approximately one and a half inches in size and have wide lips to permit said connecting cords to be tied to them with a surgeon's knot.

5. The retainer of claim 1 wherein said three cords connecting said fabric covered hook and suction cups to waist belt are 100 percent nylon, approximately one eighth of an inch in diameter.

6. The retainer of claim 1 wherein said three cords are adjustably tied to said belt with knots such as surgeon's knots; said cords being of sufficient length to adjust by shortening or lengthening, approximately twenty one inches long.

7. A sitting position adjustable musical instrument retainer with a waist worn retaining belt attached to a musical instrument with strap pegs of the guitar family comprising;

a) an adjustable length waist belt having a first end and a second end, including means for attaching about one's waist to which the following parts are attached b) a short cord having a first end and a second end; said first end having means for attaching to the right front of said waist belt; with said second end of said cord attaching by appropriate means to a suction cup; said suction cup attaching to right rear side of said instrument after said cord is looped around instrument's right side strap peg;

c) another adjustable length cord having a first end and a second end; said first end having means for attaching to the left front of said waist belt; with said second end having means of attaching to a hook which attaches to the left instrument strap peg by looping its cord around said peg and grasping itself to said cord;

d) another adjustable length short cord having a first end and a second end; said first end having means for attaching to left front portion of said belt; with said second end having means for attaching to a suction cup which attaches to the bottom front of said instrument's body.

8. The retainer of claim 7 wherein the waist belt is a fabric rope, such as 100% rayon, approximately one quarter inch in diameter; being long enough to be one size fits all, approximately 64 inches in length.

9. The retainer of claim 7 wherein said hook is an approximately three quarter inch fabric covered hook which is tied to said connecting cord by a bowline knot.

10. The retainer of claim 7 wherein said suction cups are approximately one and a half inches in diameter and have wide lips to facilitate tying to said cords by a surgeon's knot.

11. The retainer of claim 7 wherein the said three cords connecting said covered hook and said suction cups to said waist belt are one hundred percent nylon, approximately one eighth inch in diameter.

12. The retainer of claim 7 wherein the length of said three cords are made adjustable by tying and retying the connecting knot, a surgeon's knot; said cords being long enough to be adjustable, approximately twenty one inches.

13. The retainer of claim 7 wherein said right side suction cup and said covered hook are removed from said cords and are replaced by loops formed by tying bowline knots on said second end of said cords; said loops now being used to gasp said instrument's pegs.

14. The retainer of claim 1 or claim 7 wherein no waist belt is provided an cords are adjustably attached by appropriate means to an article of clothing in the waist area of said sitting position player, such as his own belt.

15. The retainer of claim 14 wherein the means of adjustably attaching said cord's said first end is by creating a loop formed by tying a bowline knot; said loops gasping said player's own belt.

16. The retainer of claim 1 or claim 7 wherein the said parts comprising said invention, namely said covered hook, two suction cups, three cords, and waist belt can be recombined, with said knots being retied as a kit or in different variant configurations to meet special needs of players.

17. The retainer of claim 16 wherein alternative adjustable clothing fasteners are provided for said three cords' first ends, such as hooks and adjustable barrel locks to use to attach to said provided belt or to said player's own waist belt.

18. The retainer of claim 17 wherein a short spread resister string is provided, approximately six to ten inches long to use with said variant configurations such as said hook attached to said second ends of two cords by appropriate knot, said cords first ends attaching, one to the left side and one to the right side of said provided belt or to player's own belt, with or without said belt holding hooks with adjusting barrel locks.

19. The retainer of claim 18 wherein the spread resister string ties the two cords close together by appropriate means' such as a surgeon's knot, approximately three inches from the said sound hole lip gripping hook.

20. The retainer of claim 17 wherein said two suction cups grasp the front, rear or sides of said guitarlike instrument, one to the leaf and one to the right, said suction cups being connected together by one tying to the first end of one of the said cords and the other tying to the second end of said cord, each suction cup also being attached to another of these said cord's second ends; these two cord's first ends now running back to tie to the said provided belt or the said player's own belt with or without the belt holding hooks with adjusting barrel locks.

* * * * *